US006422916B1

(12) United States Patent
Enku

(10) Patent No.: US 6,422,916 B1
(45) Date of Patent: Jul. 23, 2002

(54) TOY DOLL

(75) Inventor: Akihiro Enku, Kyoto-Fu (JP)

(73) Assignee: Kabushiki Kaisha Volks, Kyoto (JP)

( * ) Notice: Subject to any disclaimer, the term of this patent is extended or adjusted under 35 U.S.C. 154(b) by 0 days.

(21) Appl. No.: 09/967,915

(22) Filed: Oct. 2, 2001

(30) Foreign Application Priority Data

Oct. 13, 2000 (JP) ..... 2000-313446

(51) Int. Cl.[7] ..... A63H 11/00; A63H 13/00; A63H 3/20

(52) U.S. Cl. ..... 446/330; 446/375; 446/376; 446/383

(58) Field of Search ..... 446/330, 354, 446/355, 356, 376, 377, 378, 383, 276

(56) References Cited

U.S. PATENT DOCUMENTS 3,648,405 A * 3/1972 Tepper
3,699,713 A * 10/1972 Sapkus et al.
4,006,555 A * 2/1977 England et al.
4,274,224 A * 6/1981 Pugh et al.
4,623,318 A * 11/1986 Tsiknopoulos et al.
4,673,367 A * 6/1987 MacBain
5,588,898 A * 12/1996 Ooba
6,089,950 A * 7/2000 Lee et al.

* cited by examiner

*Primary Examiner*—Derris H. Banks
*Assistant Examiner*—Ali Abdelwahed
(74) *Attorney, Agent, or Firm*—Ronald R. Snider; Snider & Associates

(57) ABSTRACT

This invention discloses a toy doll which can be moved and rotated like a human being. Once a pose is taken the pose is maintained. The toy doll comprises an upper body, an abdomen portion constructed of an upper abdomen and a lower abdomen and a lower body, wherein an interconnecting bar connects the body portions and the abdomen portions which rub against each other and are movable. They are also forced toward the center of the interconnecting bar.

5 Claims, 10 Drawing Sheets

TOY DOLL

RELATED APPLICATION

This present disclosure relates to subject matter contained in Japanese Patent Application No.2000-313446 (filed on Oct. 13, 2000) which is expressly incorporated herein by reference in its entirety.

BACKGROUND OF THE INVENTION

1. Field of the Invention

This invention relates to a toy doll, and it provides the doll wherein body portions, arm portions, and other portions can move naturally like a human being.

2. Description of the Prior Art

In the prior art, body portions, arm portions and leg portions of a doll were provided in deformable and yieldable forms to show its various attitudes and poses. Various kinds of clothing are ready for the toy dolls and robotic toys, wherein the wear is optionally changed according as designed. It should be also noted that the doll may lend itself to various other types of use, such as providing lifelike figures for use in displaying clothing or use by artists, photographers, cinematographers or the like.

The following kinds of toy dolls in which an arm, a body portion and a leg can be deformable and yieldable have already been marketed.

In prior art as shown in FIG. 9A, and FIG. 9B, a body portion (101) is divided into an upper body (102), an abdomen and a lower body, each and rotatable condition, while an arm (105) and a leg (106) are also connected in yieldable and rotatable condition. The arm (105) has an elbow (107) in yieldable and rotatable condition, while the leg (106) has a knee (108) in the same condition.

In prior art shown in FIG. 10A and FIG. 10B, a body portion (101) is divided into an upper body (101), an abdomen (103) and a lower body (104), wherein an interconnecting material (109) which runs through the abdomen (103) is made of: elastic rubber or a pulling springs and which connects the upper body (103) and the lower body (104) in deformable and yieldable condition.

Further, in recent days, a new construction for an arm portion of a toy doll has been developed, where both sides of the upper body portion is declined toward its bottom to provide an interconnecting surface and an axis receiver is established on the surface. An interconnecting axis is prepared on the shoulder and is sustained on the axis receiver in rotatable condition, so that the movement of the arm portion has realistic like human arm actions.

SUMMARY OF THE INVENTION

In the prior art shown in FIGS. 9A, 9B, 10A and 10B, there is a toy doll which may be bent in various poses, but there is a limit on the relative movement wherein 60 degrees is a maximum angle for the movement in front and rear while 30 degrees is for the movement on right and left accordingly. In theory, in order to obtain more large angles exceeding the above limits, wider gaps can be prepared to increase movable clearance on connecting portions, but in practical performance when the gap between the connecting portions becomes large, the toy doll becomes too large. Because it is very difficult to prepare such a large gap the maintenance of a small doll size cannot be attained.

With regard to the construction adopted by the prior art shown in FIG. 10A and FIG. 10B, rubber or spring material is adopted for the body portions, whereas pulling power caused by the material and friction power caused on the connecting portions may easily become unballanced, so that the required pose for the toy doll is rapidly lost. In other words, the required maintenance of the pose becomes difficult. This is a fatal defect for this prior art.

There was already developed another structure of an arm portion, wherein this structure has an interconnecting axis sustained on an axis receiver. It has the defect that it cannot realize action of the shoulder joint in the front and rear or the up and down. Also this structure cannot provide vibration of the shoulder portions themselves nor rotation of the shoulder without rotating of the arm portion.

The present invention has an object to provide a toy doll wherein any movement can be performed naturally like the action of a human being. Also once poses are taken by the toy doll, they can be maintained for the required time. In order to realize this concept, the inventor has made many experiments and after due trial and error, he has found a new result for the object. As a result, he provides an outer cover on the connecting portions. The outer cover is fitted with body parts while the outer cover is not firmly fixed on the body parts. The cover is inserted movably and rotatably on the body parts, and thus the outer cover works over the connecting portions in correspondence with the movement of the body parts. This device prevents occurrence of some large gaps therebetween, and each bending on the connecting portions becomes very smooth. In the body portion, an upper abdomen and an lower abdomen comprising an abdomen portion are provided. On the connecting portion to interconnect an arm and the body portion an outer cover is provided as a shoulder cover.

A toy doll developed by this invention comprising:

an upper body forming a breast;

an abdomen portion constructed by an upper abdomen and a lower abdomen;

a lower body forming a waist;

an interconnecting bar connecting the upper body and the lower body penetrating through the abdomen portion;

a lower end of the upper body and an upper end of the upper abdomen fitted together, which rub against each other and which rotate with respect to each other;

a lower end of the upper abdomen and an upper end of the lower abdomen fitted together which rub against each other and which rotate with respect to each other;

a lower end of the lower abdomen and an upper end of the lower body fitted together which rub against each other and which rotate with respect to each other;

wherein the upper body and the lower body are forced by the interconnecting bar toward a center of the interconnecting bar via the abdomen portion: and wherein the interconnecting bar provides for bending and rotation between the upper abdomen and the lower abdomen in correspondence with the movement between the upper body and the lower body.

A toy doll developed by the invention also comprises:

an upper body forming a breast;

an abdomen portion having an upper abdomen and a lower abdomen;

a lower body forming a waist and having a round upper and central position opening upward formed on an upper and central position;

an interconnecting bar connecting the upper body and the lower body which penetrates through the abdomen portion;

round joints formed on both ends of the interconnecting bar;

wherein the round joints are forced toward a center of the interconnecting bar;

the upper abdomen having a round concave mouth directed downward and formed on a central of a lower area of the upper abdomen;

wherein a round joint on one side of the interconnecting bar is rotatably fitted into the round concave mouth;

wherein both the upper abdomen and the lower abdomen have cavity formed mouths;

wherein the lower abdomen is rotatably connected to the connector;

wherein a round joint on the other side of the interconnecting bar is rotatably fitted into the round concave mouth of the lower body; and wherein the interconnecting bar provides for bending and rotation between the upper abdomen and the lower abdomen in correspondence with movement between the upper body and the lower body.

The present invention also discloses a toy doll, wherein an interconnecting bar comprises as below;

a round joint having a hollow cylinder through which a coiled spring is equipped;

spring stopper pins connected to the coiled spring and the round joint;

a sustaining bar inserted into the cylinder in order to maintain length of the interconnecting bar;

wherein the coiled spring is held at both ends by the spring stopper pins; and wherein, when the sustaining bar is inserted in the coiled spring, both ends of the coiled spring are held by the spring stopper pins in the round joint.

A toy doll further developed by the invention comprises:

a body forming a body portion;

an arm forming an arm portion;

a barrel-shape cover for a shoulder fitted between a shoulder joint and an arm joint;

a shoulder connecting means interconnecting the shoulder joint and the arm joint through the barrel shape cover for the shoulder;

a round cavity formed in the inside of the shoulder, having a mouth directed toward the shoulder joint and a concave axis receiver facing on the mouth through the round cavity;

a round joint formed on one end of the shoulder connecting means;

wherein the round joint is rotatably fitted with the concave axis receiver;

wherein the barrel-shape cover for the shoulder is disposed its surface from the mouth of the shoulder joint and rotatably fitted over the round cavity;

wherein the arm joint is movably fitted on the disposed and partly surface on the barrel-shape cover and also rotatably fitted into the other end of the shoulder connecting means; and wherein the shoulder connecting means between the shoulder joint and the arm joint allows the barrel-shape cover to bend and rotate together with the arm portion.

BRIEF DESCRIPTIONS OF THE DRAWINGS

Figure 3:
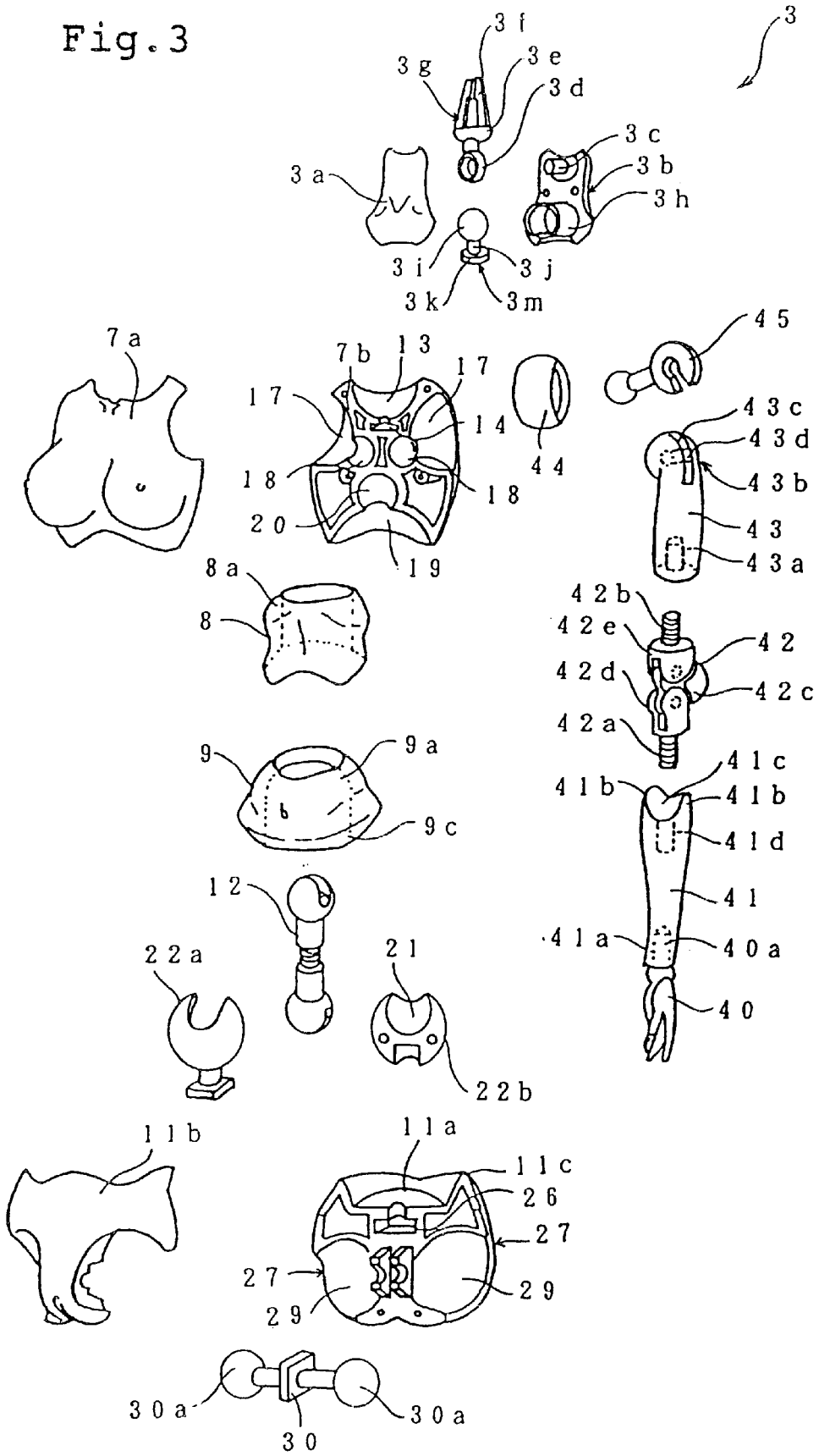

FIG. 3 an exploded perspective view showing the body portion and an arm.

Figure 4:
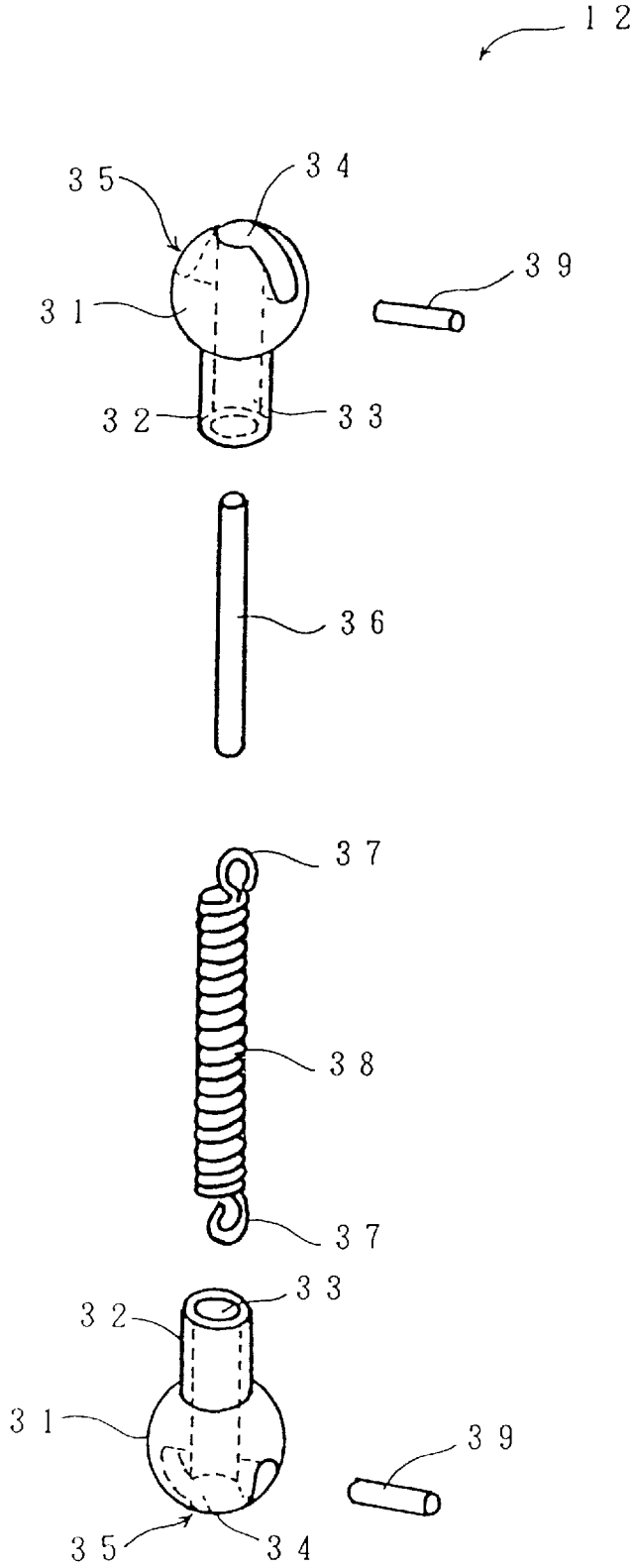

FIG. 4 is an exploded perspective view for an interconnecting bar shown in FIG. 3.

Figure 5:
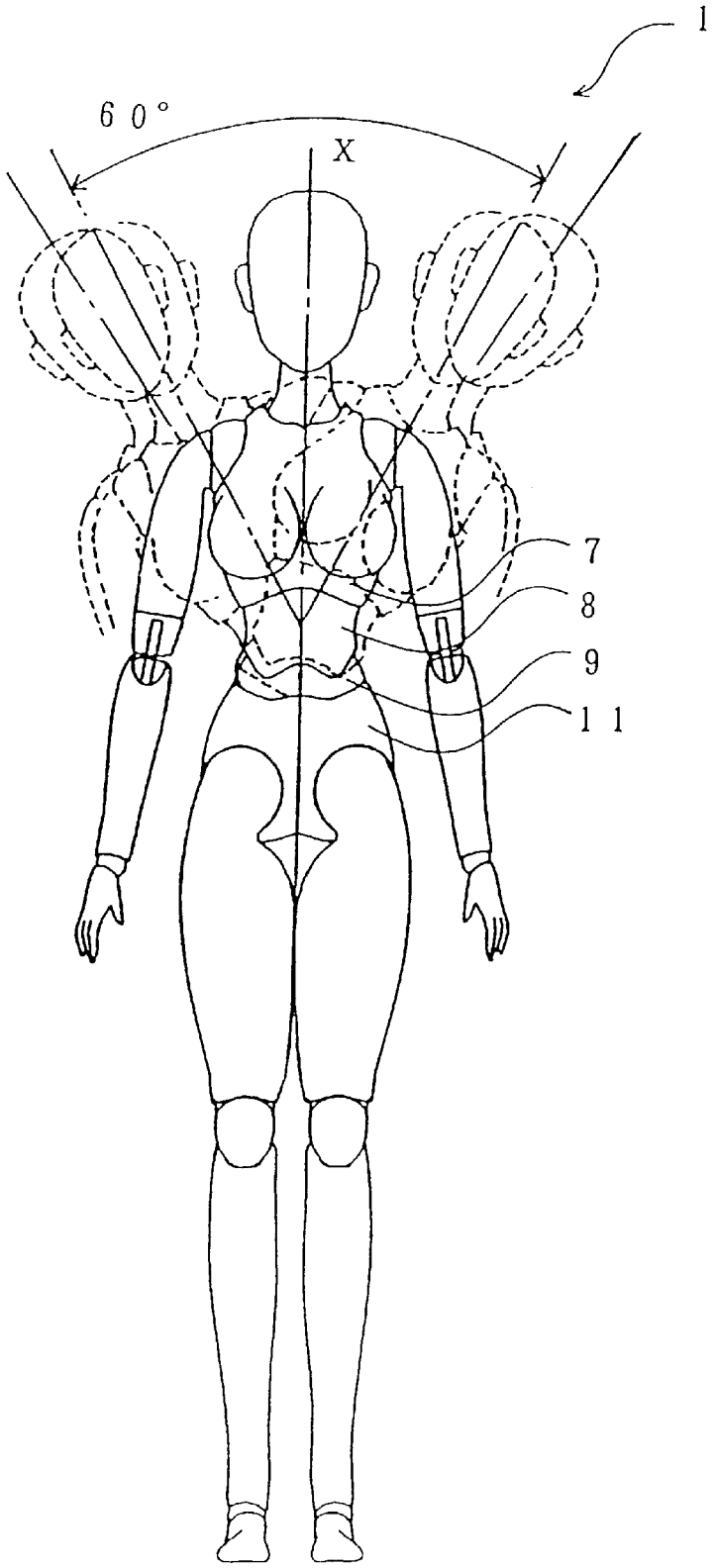

FIG. 5 is a front view explaining movement from side to side for the body portion.

Figure 6:
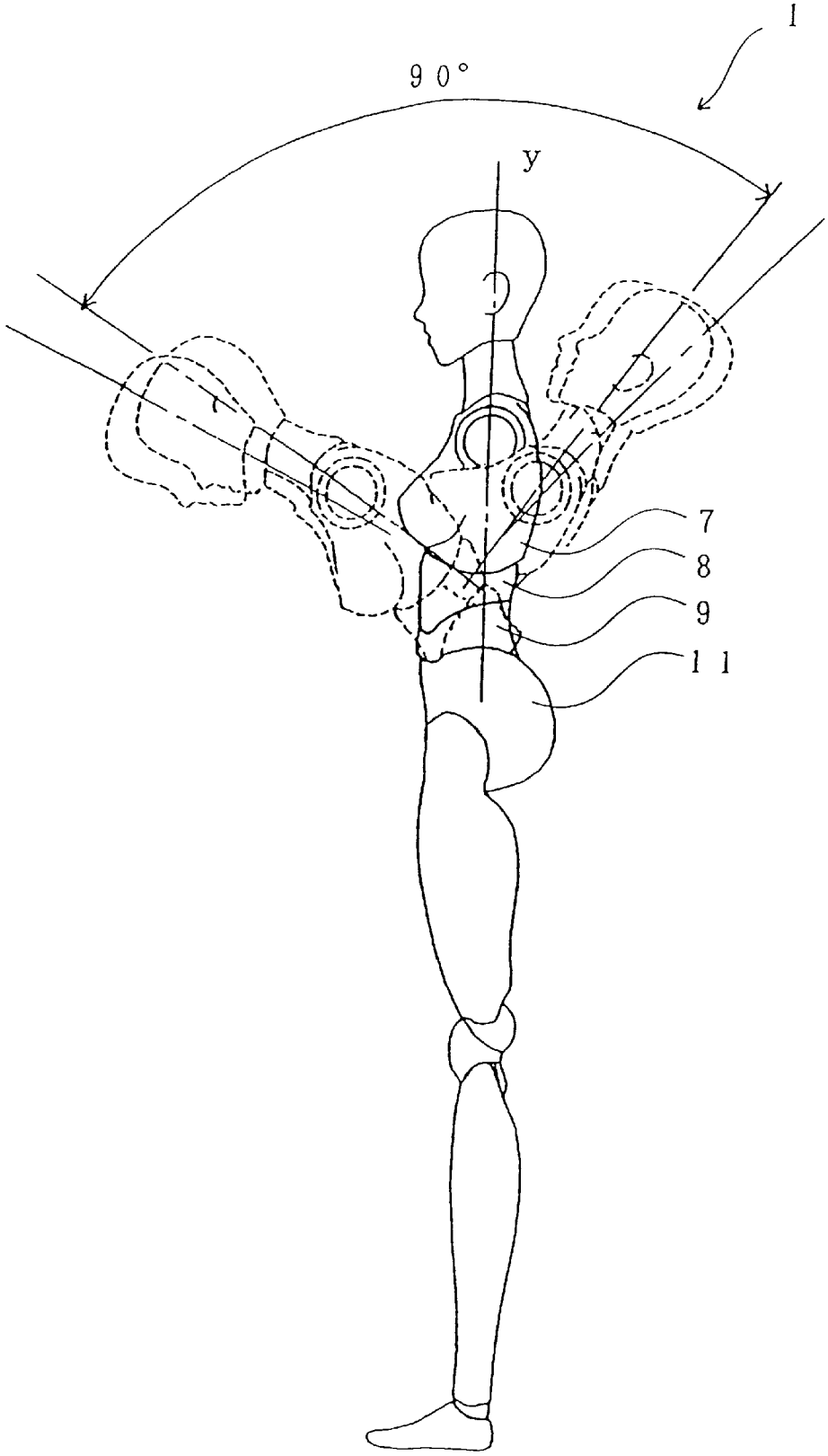

FIG. 6 is a side view explaining the movement from back to forth for the body portion.

Figure 7:
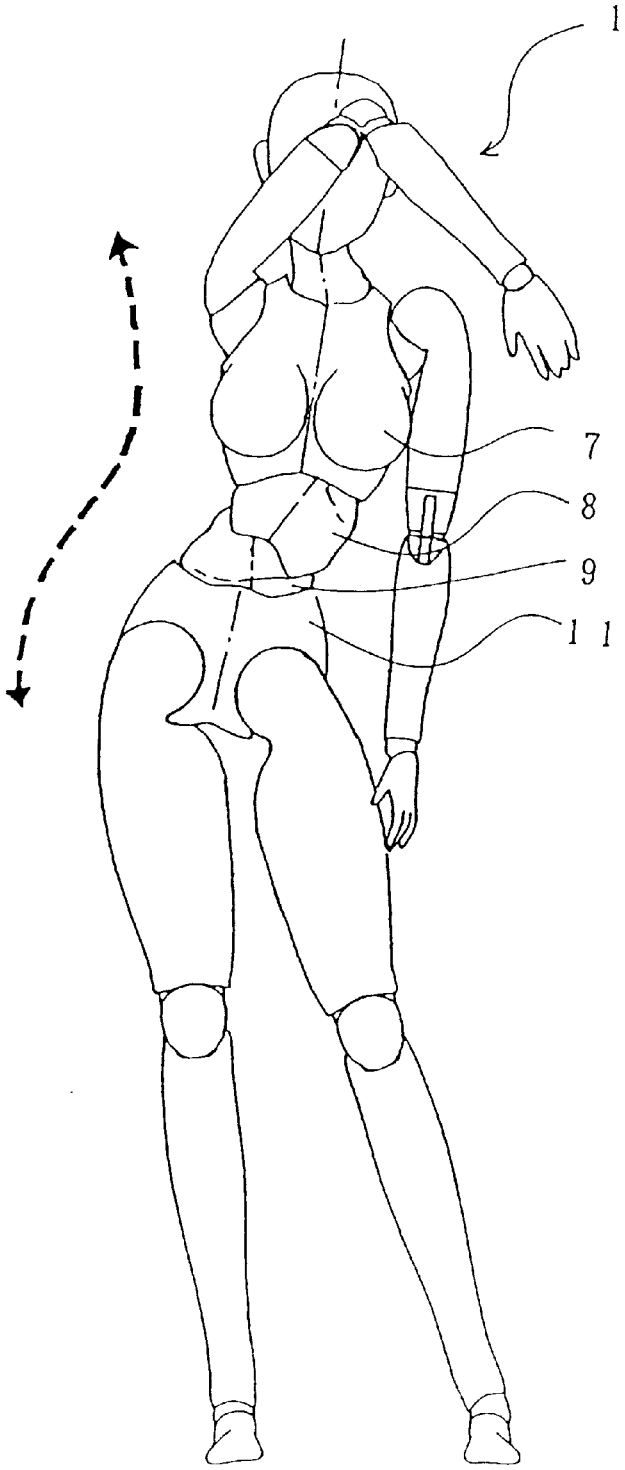

FIG. 7 is a front view showing a twisted condition for the body portion according to a dotted line.

Figure 8:
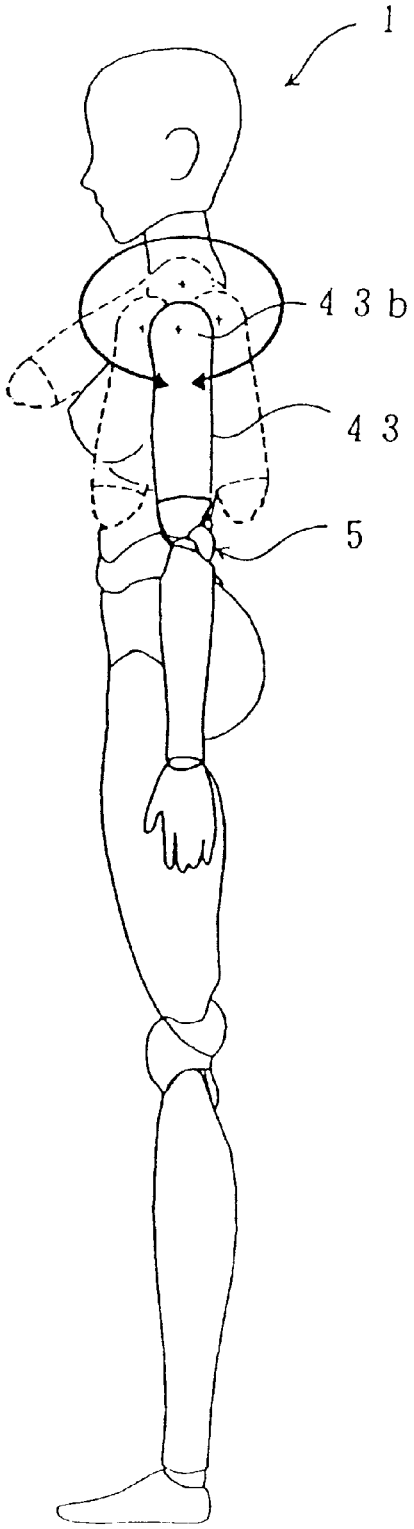

FIG. 8 is a side view showing rotating movement of the arm according to a line.

Figure 9A:
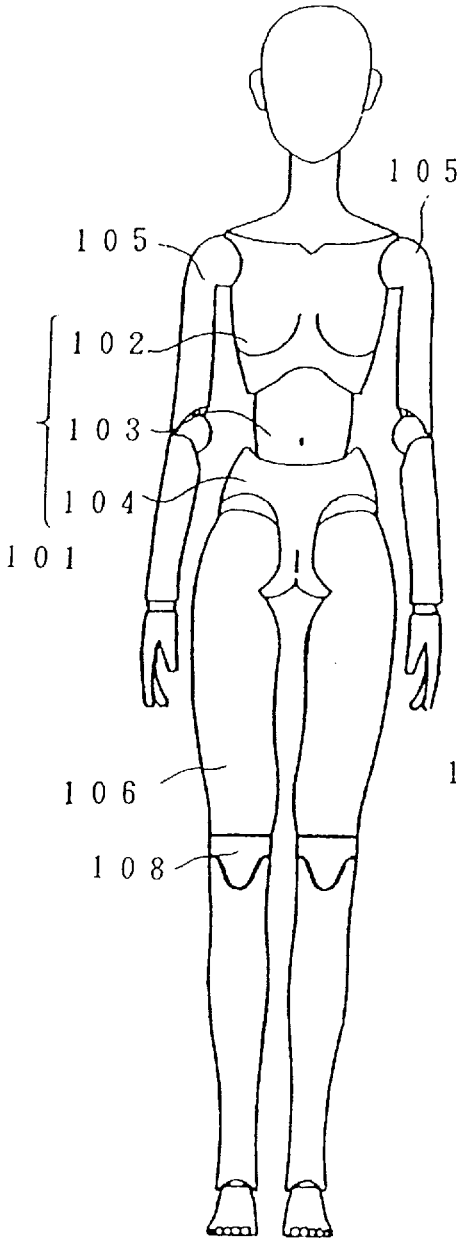
PRIOR ART Fig.9A

FIG. 9A is a plan view of a toy doll developed by the prior art.

Figure 9B:
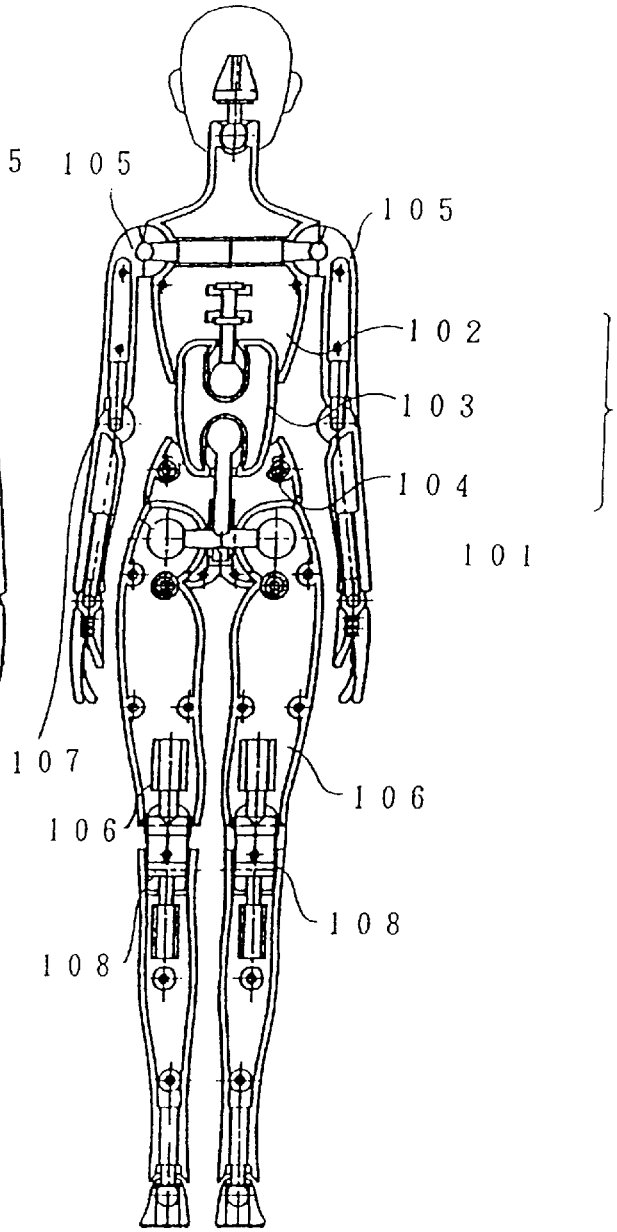

FIG. 9B is a longitudinal sectional view of FIG. 9A showing the inner construction of the toy doll.

Figure 10A:
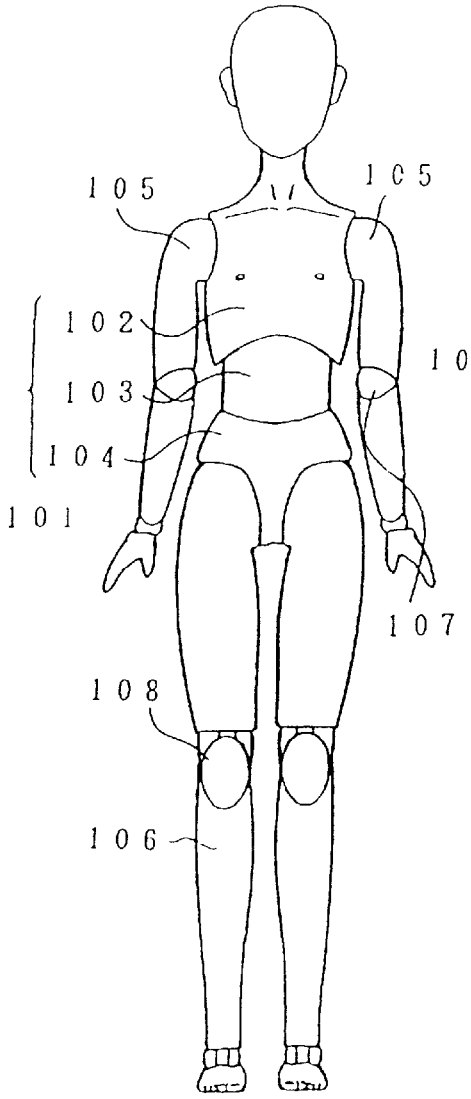
PRIOR ART Fig.10A

FIG. 10A is a plan view of the toy doll developed by another prior art.

Figure 10B:
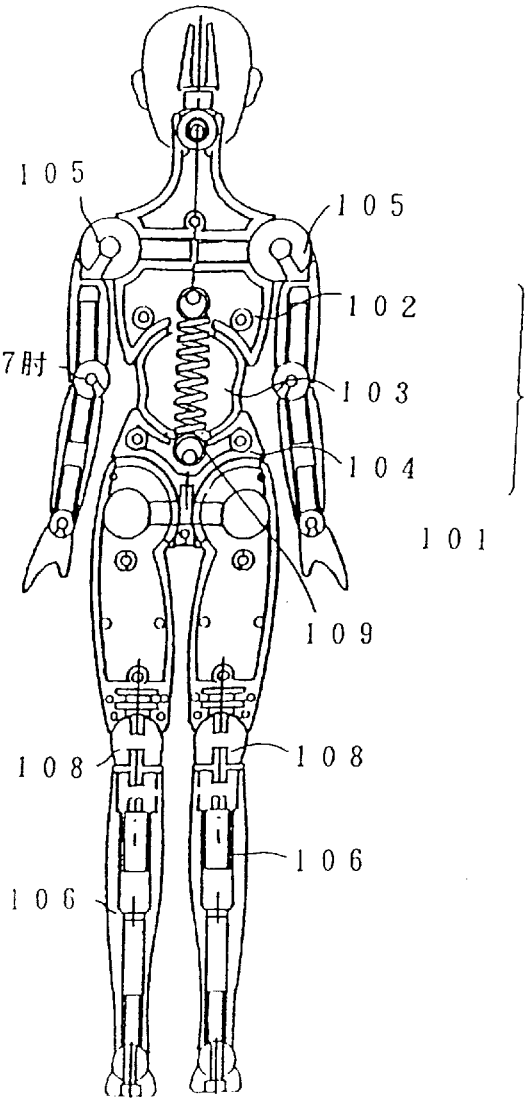

FIG. 10B is a longitudinal sectional view of FIG. 10A explaining the inner construction of the toy doll.

DESCRIPTIONS OF PREFERRED EMBODIMENT

Now, preferred embodiments shall be explained with reference to the submitted figures.

Figure 1:
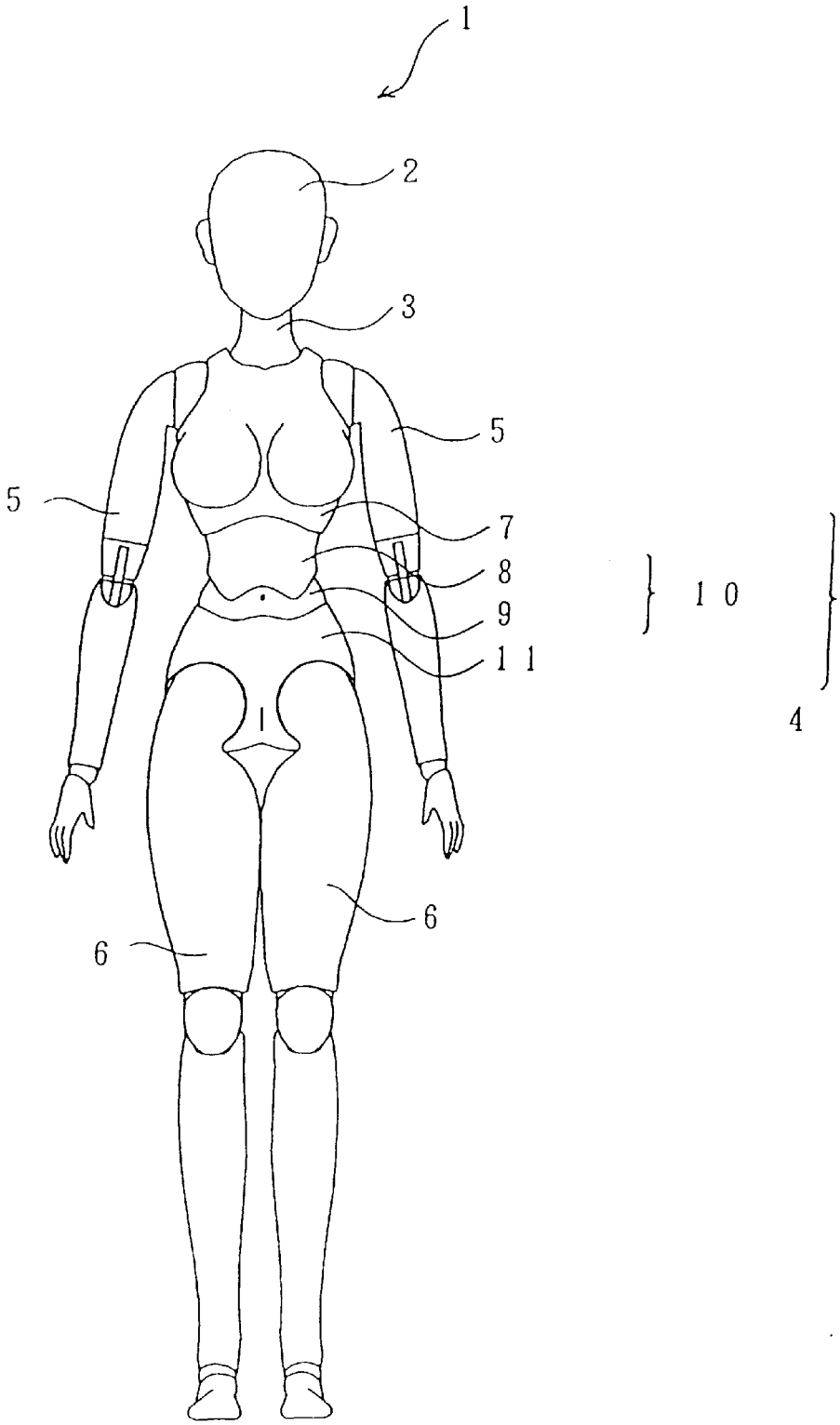
FIG. 1 is a front view of a toy doll of the present invention.

In reference to FIG. 1, the numeral 1 is a toy doll, which includes a head (2), neck (3), a body portion (4), an arm (5) and a leg (6). The body portion (4) constitutes an upper body (7) forming a breast, an abdomen portion including an upper abdomen (8) and a lower abdomen (9), and a lower body (11) forming a waist.

Figure 2:
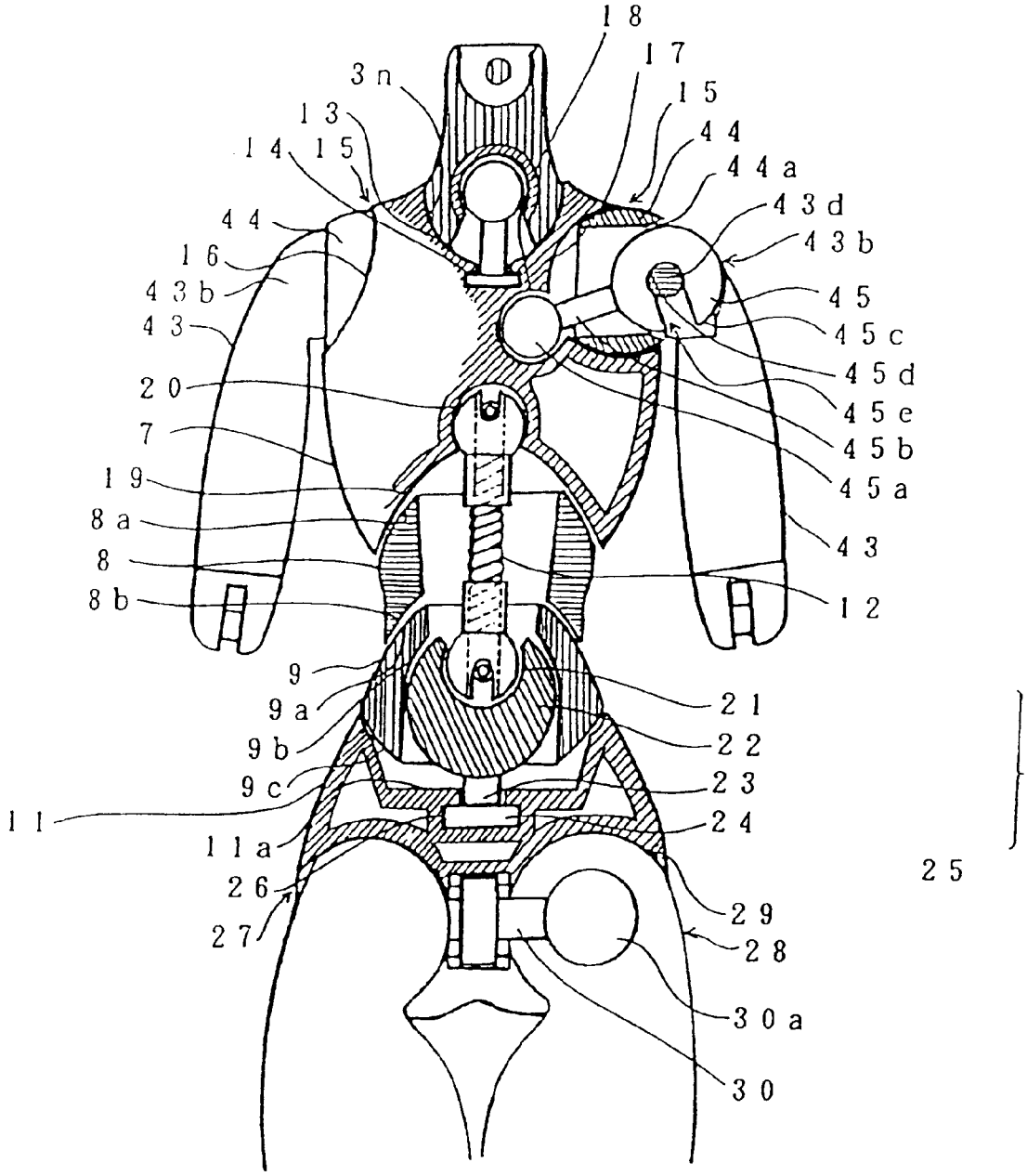
FIG. 2 is a longitudinal sectional view showing inner constructure of a body portion for the toy doll.

Referring to FIG. 2, the upper body (7) and the lower body (11) are connected together with the upper abdomen (8) and the lower abdomen (9) by an interconnecting bar (12) which penetrates therebetween, and this interconnecting bar (12) is forced to its center position.

As shown in FIG. 3, the neck (3) has a front neck cover (3*a*) and a rear neck cover (3*b*), and a column-like pin (3*c*) is prepared extending forward from one end of the rear neck cover (3*b*) and the pin (3*c*) fits into a round ring (3*d*) established in a lower end of a head sustaining pin (3*g*), while the front neck cover (3*a*) and the rear neck cover (3*b*) face each other. On the upper end of the head sustaining pin (3*g*), a pen nib like built-in top (3*f*) is formed via a trapezoid holder (3*e*). A hollow cylindric sustainer (3*h*) which has an open wall below is formed on a lower end of the rear neck cover (3*b*). A connecting stem (3*j*) is prepared wherein a round joint (3*i*) is formed above while a circular pedestal (3*k*) is prepared below. These three parts (3*j*, 3*i* and 3*k*) provide a neck connecting portion (3*m*). The round joint (3*i*) is rotatably inserted into the hollow cylindric sustainer (3*h*). The bottom shape of the front neck cover (3*a*) as well as the rear neck cover (3*b*) becomes identical with the neck (3) shape as shown in FIG. 2 after the two covers are fitted together. The round ring (3*d*) of the head sustaining; pin (3*g*) is now inserted into the column-like pin (3*c*) movably right and left, and the round joint (3*i*) of the neck connecting portion (3*m*) is also movably inserted into the hollow cylindric sustainer (3*h*) while the connecting stem (3*j*) is fitted with the open wall of the hollow cylindric sustainer (3*h*), and then the rear neck cover (3*b*) is connected fixedly with the front neck cover (3*a*), and thus the neck is completed.

In the bottom of its central area for the head (2), an insertion hole is established therein (not shown in the drawing), into which the pen nib like built-in top (3*f*) of the head sustaining pin (3*g*) inserted and thus the head (2) and the neck (3) are connected together. By this connection, the head (2) can be moved right and left on the center of the column-like pin (3*c*).

As shown in FIG. 2 and FIG. 3, on the upper center of the upper body (7), a dome-like concave (13) is formed so that the neck joint (3*n*) of the neck (3) can be fitted thereon in yieldable and rotatable condition. In the inner central area of the dome-like concave (13), a built-in cavity (14) is formed to receive the circular pedestal (3*k*) of the neck connecting portion (3*m*), and at the same time a hole through which the connecting stem (3*j*) is running is drilled. In the inside of a shoulder joint (15), a dome-like cavity (17) having a mouth (16) is formed, and also a concave receiver (18) in a round bird nest shape to receive a round joint (45*a*) is formed with the mouth (16) of the shoulder joint (15) extending along the cavity (17). At the bottom of the upper body (7), a round cavity (19) is prepared opening toward below, and on the central ceiling of the round cavity a round receiver (20) is also established. As shown in FIG. 3, the body (7) is composed of a breast cover (7*a*) and a back cover (7*b*) which includes the dome-like cavity (13), the built-in cavity (14), the dome-like cavity (17), the concave receiver (18) and the round cavity (19).

As shown in FIG. 2, the upper abdomen (8) is provided in a hollow condition opening both above and below, and its outer shape is established as an outer cover for an area from the breast and the abdomen. An upper and outer end cover (8*a*) for the upper abdomen (8) is formed in a dome-like shape and it is adapted to be fitted into the round cavity (19) in a stable and rotatable condition while a lower end cover (8*b*) is shaped in round and curved condition.

The lower abdomen (9) is also provided in a hollow condition opening both above and below, and its outer shape is established as an outer cover for an area from the abdomen to the waist. An upper and outer end cover (9*a*) for the lower abdomen (9) contacts the lower end cover (8*b*) formed in a dome-like shape fitting together the upper abdomen (8) and the lower abdomen (9) in a stable and rotatable condition, while the lower end cover (9*b*) is shaped in a dome-like directing downward.

An upper surface (11*a*) of the lower body (11) is formed like a crater, and on the central bottom of the upper surface (11*a*), a round connecting means (22) having a round cavity (21) for the lower body (11) is formed, and is shaped like a round bird nest and is opening upward, and a fitting cavity (26) is formed just below the round connecting means (22), into which an oblong pedestal (24) of a lower abdomen: receiver (25) is adapted to be inserted via an interconnecting bar (23), while a hole is prepared on the central bottom, from which a neck of the interconnecting bar (23) runs through.

With reference to FIG. 3, in the bottom and inner area of the lower body (11), a dome-like cavity (29) with an open space in front is established in front of a leg (27), and in the middle of the dome-like cavity (29), a round joint (30 *a*) is positioned via a connecting stem (30). The lower body is produced by a front waist cover (11*b*) and a rear hip cover (11*c*), while the front waist cover includes the round cavity (21), the round connecting means (22), the fitting cavity (26) and the dome-like cavity (29).

As shown in FIG. 4, the interconnecting bar (12) is designed by a round body (31) and a cylinder (32), and at the same time a hollow channel (33) running through the round body (31) and the cylinder (32). This interconnecting bar (12) has also a round joint (35), a small slit (34) drilled into the center of the round body (31) including the hollow channel (33), a sustaining stem (36) which is inserted into both ends of the cylinder (31) and the hollow channel (33), so that the sustaining stem (36) maintains the length of the interconnecting bar (12) without bending, a coiled spring (38) equipped with a ring (37) on each end, and a spring stopper pin (39) wherein the ring (37) is set thereon and inserted on the small slit (34) fixedly. The sustaining stem (36) is now inserted into the coiled spring (38) and then each end of the coiled spring (38) is inserted into the cylinder (32) of the round joint (35) whereon the ring (37) appears over the slit (34). The spring stopper pin (39) is then inserted into the ring (37) and the pin (39) is fixedly set in the bottom of the small slit (34). Thus, the coiled spring (38) is suspended onto the round joint (35). When the coiled spring (38) is extended in tension, each of the round joint (35) is forced toward the center of the interconnecting bar (12).

In reference with FIG. 3, the arm (5) has a palm (40) and a fore arm (41) into which a column-like fitting cavity (40*a*) is prepared lengthwise from a wrist area with rugged ditches, and a hollow palm receiver (41*a*) to connect the palm (40) with the fore arm (41) into the column-like fitting cavity (40*a*) in rotatable condition is now formed. On the top end of the fore arm (41), a mountain-like wall (41*b*) and a cavity cylinder (41*c*) are formed, and this cavity cylinder (41*c*) has a shaft receiver (41*d*) which receives a fitting shaft (42*a*) of an elbow joint (42). In the upper part of the; elbow joint (42), another fitting shaft (42*b*) is prepared so that the shaft is adapted to fit into a shaft receiver (43*a*) prepared in an upper arm (43). An arm joint (43*b*) is also established in the upper arm (43), and a vertical slit (43*c*) is prepared on the arm joint (43*b*). In the center of the vertical slit (43*c*), a center axis (43*d*) is provided.

The elbow joint (42) is composed of a lower connecting means (42*d*) which is assembled with the fore arm (41) and an upper connecting means (42*e*) which is also assembled with the upper arm (43). At the same time, in the elbow joint (42), a round mountain-like elbow top (42*c*) is prepared to control the lower connecting means (42*d*) and the upper connecting means (42*e*).

The fitting shaft (42*b*) is fitted into the shaft receiver (43*a*) and the lower connecting means (42*d*) is fitted into the cavity cylinder (41*c*), while the fitting shaft (42*a*) in the lower connecting means (42*d*) is fitted into the shaft receiver (41*d*) and the column-like fitting cavity (40*a*) is set with the hollow palm receiver (41*a*). Thus the arm portion shall be flexibly moved like a human arm.

As shown in FIG. 2, the shoulder joint (15) and the arm joint (43*b*) are connected by a barrel-like cover (44) in a hollow condition which is to be fitted between the shoulder joint (15) of the upper body (7) and the arm joint (43*b*) of the upper arm (43), and a shoulder connecting means (45) which penetrates through the barrel-like cover (44). The cover (44) has a circular surface to be fitted with the dome-like cavity (17), while the cover (44) exposes one part of the circular surface from the mouth (16) of the shoulder joint (15). Further, inner surface of the end of the cover (44) onto which the arm joint (43*b*) contacts provides an circular cavity (44 *a*), while the shoulder connecting means (45) has at one end a round ended connecting stem (45*b*) which can be rotatably fitted with the cavity receiver (18) of the upper body (7), and at the same time, as shown in FIG. 3, at the other end, the connecting means (45) has a C-letter like engagement (45*c*) which has enough thickness to be fitted with a vertical slit (43*c*) via connecting stem (45*b*) and which also becomes in its surface a part of a round body fitting with the arm joint (43*b*) in its round surface. The center of the C-letter like engagement (45*c*) has a round hole (45*d*) through which a center pin (43*d*) is rotatably fitted with and a notch (45*e*) through which the center pin (43*a*) runs through the round hole against the round ended connecting stem (45*b*). When the round stem (45*b*) is fitted with the dome-like cavity (17) in the condition that the round joint (45*a*) is passing through the barrel-like cover (44), the round surface of the arm joint (43*b*) fitted with the C-letter like engagement (45*c*) and the circular cavity (44*a*) are adapted to have enough length for connecting in free fitting condition.

Now, the assembling procedure is explained.

The circular pedestal (3*k*) of the neck connecting portion (3*m*) which is extending from the bottom of the neck (3) is fitted with the built-in cavity (14) prepared in the back cover (7*b*), and the round joint (45*a*) is fitted into the cavity receiver (18) in the condition that the round hole (45*d*) prepared in the C-letter like engagement (45*c*) is fitted with the center axis (43*d*) so that the barrel-like cover (44) may be fitted with the dome-like cavity (17) through the connecting means (45). Then, the round body (31) is placed over the round cavity for the upper body (20) in the condition that the interconnecting bar (12) is running through the upper abdomen (8) and the lower abdomen (9). In addition, as shown in FIG. 3, the round body (31) is fitted with a vertically divided front portion (22*a*) formed in the round connecting means (22) as a part of the round cavity (21) for the lower body. Further, the oblong pedestal (24) is fitted with a built-in cavity (26) established in a rear bottom outer cover (11*c*). Then, a breast front outer cover (7*a*) is fixedly connected with a back rear outer cover (7*b*), and also a front waist outer cover (11*b*) is fixedly connected with the rear bottom outer cover (11*c*), while a vertically divided rear portion (22*b*) is fixedly fitted with the front portion (22*a*).

After the above assembly procedure, the upper body (7) and the lower body (11) are now forced toward the center of the interconnecting bar (12) by the coiled spring (38) in the condition that the upper abdomen (8) and the lower abdomen are pinched together by the interconnecting bar (12), and an outer surface of the outer end covers (8*a*) is movably fitted with the round cavity (19), while the outer surface of the outer: end cover (9*a*) is in frictional engagement with and movably fitted with the inner surface of a lower end cover (8*b*) and the inner surface of another lower end cover (9*b*) is also in frictional engagement with and movably fitted with the outer surface of the round connecting means (22) of the lower abdomen receiver (25). At the same time, the outer surface of an end cover (9*c*) is in frictional engagement with and movably fitted with an upper end of the crater-like surface (11*a*) of the lower body (11).

Further, the barrel-like cover for the shoulder (44) is in frictional engagement with and movably fitted with the dome-like cavity (17) in the condition that the cover (44) is exposing a part of its round surface from the mouth (16) of the shoulder joint (15), while the arm joint (43*b*) is freely and movably fitted with the circular arc cavity (44 *a*) as the exposing round surface of the cover (44) and also fitted movably with the circular surface of the C-letter like engagement (45*c*) of the shoulder connecting means In the present embodiment, the round body (31) of the interconnecting bar (12) is now fitted with a round body for the lower body (21) which is formed in the lower abdomen receiver (25) of the lower body (11), the upper body (7) and the lower body (11) are connected by the interconnecting bar (12) in the condition that the upper abdomen (8) and the lower abdomen (9) are pinched together, and therefore, as shown in FIG. 5, the upper body (7), the upper abdomen (8) and the lower abdomen (9) are movable toward left and right based on the lower body (11) centering around the round body (31) fitted with the round cavity (21), while the upper body (7) and the lower body (11) are forced by the coiled spring (38) so that no gaps are caused between the lower abdomen (9) and the lower body (11) to contact the two bodies (7 and 11) in smooth movement. Even if the upper half body of the toy doll is moved in maximum toward left and light in the angle more than 60 degree on a center line of "x", the coiled spring (38) and the sustaining stem (36) works together so that a slant pose of the toy doll can be maintained without breaking the body. This is because the occurrence of the gaps or random shakings is prevented by the above constitution.

As shown in FIG. 6, when the upper half body over the lower body (11) is moved in maximum toward to and fro in the angle more than 90 degrees on a center line of "y", the occurrence of the gaps or random shaking is prevented, while such occurrence is not worried by bending or rotating movement between the upper body (7) and the lower body (11), between the lower abdomen (9) and the lower body (11), between the upper abdomen (8) and the lower abdomen (9), or else between the upper body (7) and the upper abdomen (8). Thus, the declined pose of the toy doll can be maintained.

The assembling between the upper body (7) and the upper abdomen (8), between the upper abdomen (8) and the lower abdomen (9), and between the lower abdomen (9) and the lower body (11), is constructed by the interconnecting bar (12) in rotatable condition contacting each other, and the interconnecting bar can move freely in the hollow hole of the upper abdomen (8) and the lower abdomen (9) centering on the round cavity (21). By this free movement, the upper abdomen (8) and the lower abdomen (9) correspond with the bending or rotating movement for the upper body (7) between the upper body (7) and the lower body (11). Thus, as shown in FIG. 7, the pose in twisted manners like S-letter or the reverse can be maintained.

The barrel-like cover for the shoulder (44) is fitted with the dome-like cavity (17), and the round joint (45*a*) is fitted with the cavity receiver (18) prepared on the dome-like cavity (17). At the same time, the arm joint (43*b*) is connected with the shoulder joint (15) in the condition that the barrel-like cover (44) is in free fitment with the C-letter like engagement (45*c*) and pinched by the C-letter like engagement (45*c*). Therefore, as shown in FIG. 8, the center of the upper arm (43) can be rotated centering around the shoulder joint (15), so that the upper arm (43) can be moved toward left and right or toward up and down. At the same time, the two arms (5) can be crossed together before the body portion (4), or else the arms (5) can be raised together or independently high above along the head (2). Moreover, as the barrel-like cover for the shoulder (44) is freely fitted in the condition that the cover (44) exposes one part of its circular surface from the shoulder joint (15), the cover (44) moves in correspondence with the bending or rotating movement of the upper arm (43) between the shoulder joint (15) and the arm joint (43*b*), whereas the outer cover on the shoulder is kept in its place and is not damaged.

As explained above, this invention provides the toy doll, wherein, as the upper abdomen and the lower abdomen can move smoothly between the upper body and the lower body in correspondence with the bending or rotating movement with the upper body, the gap occurrence between each component can be prevented, and each component can be moved like a human being. This invention also provides the toy doll which can be moved toward to and fro in the angle more than 90 degrees and toward left and right in the angle of more than 60 degrees, while once the toy doll takes its pose in twisted manners or other, the relative pose can be maintained as it is.

This invention also provides the toy doll, wherein the barrel-like outer cover for the shoulder moves in correspondence with the bending or rotating movement of the arm via the shoulder connecting means, so that the turning movement for rotating or toward to and fro or else up and down can be smoothly operated, and at the same time, the outer cover for the shoulder is kept in its place and is not damaged.

It is further understood by those skilled in the art that the foregoing description is preferred embodiment of the disclosed method and that various changes and modifications may be made in this invention without departing from the spirit and scope thereof.

What is claimed is:

1. A toy doll comprising:

an upper body forming a breast;

an abdomen portion constructed by an upper abdomen and a lower abdomen;

a lower body forming a waist;

an interconnecting bar connecting the upper body and the lower body penetrating through the abdomen portion;

a lower end of the upper body and an upper end of the upper abdomen fitted together which rub against each other and which rotate with respect to each other;

a lower end of the upper abdomen and an upper end of the lower abdomen fitted together which rub against each other and which rotate with respect to each other;

a lower end of the lower abdomen and an upper end of the lower body fitted together which rub against each other and which rotate with respect to each other;

wherein the upper body and the lower body are forced by the interconnecting bar toward a center of the interconnecting bar via the abdomen portion: and wherein the interconnecting bar provides for bending and rotation between the upper abdomen and the lower abdomen in correspondence with the movement between the upper body and the lower body.

2. A toy doll comprising:

an upper body forming a breast;

an abdomen portion having an upper abdomen and a lower abdomen;

a lower body forming a waist and having a round upper and central position opening upward formed on an upper and central position;

an interconnecting bar connecting the upper body and the lower body which penetrates through the abdomen portion;

round joints formed on both ends of the interconnecting bar;

wherein the round joints are forced toward a center of the interconnecting bar;

the upper abdomen having a round concave mouth directed downward and formed on a central of a lower area of the upper abdomen;

wherein a round joint on one side of the interconnecting bar is rotatably fitted into the round concave mouth;

wherein both the upper abdomen and the lower abdomen have cavity formed mouths;

wherein the lower abdomen is rotatably connected to a connector;

wherein a round joint on another side of the interconnecting bar is rotatably fitted into the round concave mouth of the lower body; and wherein the interconnecting bar provides for bending and rotation between the upper abdomen and the lower abdomen in correspondence with movement between the upper body and the lower body.

3. A toy doll according to claim 1, having an interconnecting bar comprising:

a round joint having a hollow cylinder through which a coiled spring is equipped;

spring stopper pins connected to the coiled spring and the round joint;

a sustaining bar inserted into the cylinder in order to maintain length of the interconnecting bar;

wherein the coiled spring is held at both ends by the spring stopper pins; and wherein, when the sustaining bar is inserted in the coiled spring, both ends of the coiled spring are held by the spring stopper pins in the round joint.

4. A toy doll comprising:

a body forming a body portion;

an arm forming an arm portion;

a barrel-shape cover for a shoulder fitted between a shoulder joint and an arm joint;

a shoulder connecting means interconnecting the shoulder joint and the arm joint through the barrel shape cover for the shoulder;

a round cavity formed in the inside of the shoulder, having a mouth directed toward the shoulder joint and a concave axis receiver facing on the mouth through the round cavity;

a round joint formed on one end of the shoulder connecting means;

wherein the round joint is rotatably fitted with the concave axis receiver;

wherein the barrel-shape cover for the shoulder joint is disposed over the shoulder joint and rotatably fitted over the round cavity;

wherein the arm joint is movably fitted on the barrel-shape cover and also rotatably fitted into another end of the shoulder connecting means; and wherein the shoulder connecting means between the shoulder joint and the arm joint allows the barrel-shape cover to bend and rotate together with the arm portion.

5. A toy doll according to claim 2, wherein joint portions are a material selected from the group consisting of plastic resin of nylon, polycarbonate and polyacetal, while portions other than the joint portions are a material selected from the group consisting of plastic resin of ABS (aclylonitril butadien stylene) and styrol.

* * * * *